US012215709B2

(12) United States Patent
Rao et al.

(10) Patent No.: US 12,215,709 B2
(45) Date of Patent: Feb. 4, 2025

(54) WATERPROOF AIR PUMP, INFLATABLE PRODUCT, AND PRODUCTION METHOD AND UTILIZING METHOD FOR INFLATABLE PRODUCT

(71) Applicant: Jiangsu Guorun Electric Co., Ltd., Huaian (CN)

(72) Inventors: Houxi Rao, Huaian (CN); Lei Chen, Huaian (CN); Xiaohui Chang, Huaian (CN)

(73) Assignee: Jiangsu Guorun Electric Co., Ltd., Huaian (CN)

( * ) Notice: Subject to any disclaimer, the term of this patent is extended or adjusted under 35 U.S.C. 154(b) by 0 days.

(21) Appl. No.: 17/882,627

(22) Filed: Aug. 8, 2022

(65) Prior Publication Data

US 2023/0349391 A1 Nov. 2, 2023

(30) Foreign Application Priority Data

Apr. 28, 2022 (CN) ..... 202210463484.8

(51) Int. Cl.

| | |
|---|---|
| ***F04D 29/40*** | (2006.01) |
| ***A47C 27/08*** | (2006.01) |
| ***F04D 29/52*** | (2006.01) |
| ***F04D 29/62*** | (2006.01) |
| ***F04D 29/64*** | (2006.01) |

(52) U.S. Cl.

CPC ..... *F04D 29/403* (2013.01); *A47C 27/082* (2013.01); *F04D 29/522* (2013.01); *F04D 29/626* (2013.01); *F04D 29/646* (2013.01)

(58) Field of Classification Search

CPC . A47C 27/082; F04D 29/403; F04D 29/4206; F04D 29/522; F04D 29/624; F04D 29/626; F04D 29/644; F04D 29/646

See application file for complete search history.

(56) References Cited

U.S. PATENT DOCUMENTS 5,890,882 A * 4/1999 Feldman ..... F04D 25/0673 5/713
6,164,314 A * 12/2000 Saputo ..... F16K 15/205 137/232
6,295,693 B1 * 10/2001 Chou ..... F04D 29/626 141/66
RE37,983 E * 2/2003 Wang ..... F04B 45/02 417/478

(Continued)

*Primary Examiner* — Kenneth J Hansen
*Assistant Examiner* — Joseph S. Herrmann
(74) *Attorney, Agent, or Firm* — Bayramoglu Law Offices LLC

(57) ABSTRACT

A waterproof air pump, an inflatable product, and a production method and a utilizing method for the inflatable product are provided. The waterproof air pump includes a waterproof shell and an air pump body removably connected in the waterproof shell. The waterproof shell includes a lower shell and a waterproof upper cover. The lower shell and the waterproof upper cover are removably connected in a relative sealing. The air pump body and the lower shell are removably connected. An air outlet of the air pump body communicates with an air outlet of the lower shell. The outer wall of the lower shell is sealingly connected to the inflatable product. The air outlet of the lower shell is located in the inner cavity of the inflatable product, and the waterproof upper cover is exposed outside the inflatable product.

19 Claims, 15 Drawing Sheets

(56) References Cited

U.S. PATENT DOCUMENTS

| | | | | |
|---|---|---|---|---|
| 6,955,527 | B2 * | 10/2005 | Yen | F04B 35/04 417/360 |
| 2001/0026763 | A1 * | 10/2001 | Chung | F04D 25/0673 417/360 |
| 2004/0143906 | A1 * | 7/2004 | Kasatshko | A47C 20/048 5/713 |
| 2019/0075930 | A1 * | 3/2019 | Zhang | F04D 29/603 |
| 2019/0271323 | A1 * | 9/2019 | Huang | A47C 27/083 |

* cited by examiner

WATERPROOF AIR PUMP, INFLATABLE PRODUCT, AND PRODUCTION METHOD AND UTILIZING METHOD FOR INFLATABLE PRODUCT

CROSS REFERENCE TO THE RELATED APPLICATIONS

This application is based upon and claims priority to Chinese Patent Application No. 202210463484.8, filed on Apr. 28, 2022, the entire contents of which are incorporated herein by reference.

TECHNICAL FIELD

The present invention relates to the technical field of air pump, particularly to a waterproof air pump, an inflatable product, and a production method and a utilizing method for the inflatable product.

BACKGROUND

At present, various inflatable products, such as inflatable mattresses, inflatable trampolines, inflatable sofas, inflatable toys, inflatable boats, inflatable swim rings, inflatable pools, and others, usually use outer air pumps for rapid inflation. When the inflatable product is used outside the home, the user of the inflatable product must bring an air pump, which is not convenient, and, larger-size inflatable products may require a more laborious process of manual inflation.

Based on the above-mentioned problems, the prior art has provided an inflatable product with built-in air pump. However, for inflatable products that contact water, such as inflatable boats, inflatable swim rings, inflatable pools and the likes, the air pump must be waterproof. If the sealing and waterproofing is not preferable, electric leakage may occur, so as to cause safety hazards. Additionally, the existing built-in air pump cannot be integrally separated from the inflatable product, can only be used with the inflatable product one-to-one, and does not facilitate to charge and maintain the air pump. Thus, once the air pump is damaged, the inflatable product cannot be used, which limits the usage and is not flexible. In addition, the existing air pump generally has a complex structure and a cumbersome production process.

SUMMARY

The main objective of the present invention is to overcome the shortcomings of the prior art and provide a waterproof air pump, an inflatable product, a production method for the inflatable product, and a utilizing method for the inflatable product. The air pump body of the waterproof air pump can be disassembled and separated integrally. When being placed inside the inflatable product, it is still convenient to repair, charge, and replace the air pump body. One air pump body can be configured with a plurality of inflatable products to use, which is flexible to use, and reduce costs. It is convenient and quick to assemble and disassemble, and water inflowing and air leakage is effectively prevented.

The technical solution in the present invention is as follows:

A waterproof air pump includes a waterproof shell and an air pump body removably connected in the waterproof shell. The waterproof shell includes a lower shell and a waterproof upper cover. The lower shell and waterproof upper cover are removably connected in a relative sealing. The air pump body and the lower shell are removably connected. The air pump body is provided with a first air outlet. A second air outlet is formed on the lower shell, and the second air outlet communicates with the first air outlet.

Further, the lower shell and the waterproof upper cover are connected to each other through a thread or fastened with each other by a screw fastening assembly, and the lower shell and the air pump body are connected to each other through a thread or fastened with each other by a screw fastening assembly.

Further, the screw fastening assembly includes guide chutes respectively and correspondingly provided on two connecting parts, and a fastening member arranged in a protruding manner that fits with the guide chutes and are rotatably fastened in the guide chutes.

Further, the second air outlet of the lower shell is connected to a one-way sealing valve piece.

Further, the bottom end surface of the lower shell is formed with a plurality of ventilation slots, the ventilation slots are arranged through the bottom end surface of the lower shell. One end of the ventilation slot communicates with the second air outlet, and the other end of the ventilation slot communicates with the outside of the lower shell.

Further, the outer wall of the lower shell is provided with a fused edge connection slot seat and a fused edge embedded on the fused edge connection slot seat. The fused edge is used to connect and seal the lower shell with the inflatable product.

An inflatable product includes the inflatable product body and the above-mentioned waterproof air pump. The outer wall of the lower shell is sealingly connected to the inflatable product body. The second air outlet is located in the inner cavity of the inflatable product body, and the waterproof upper cover is exposed outside the inflatable product body.

Further, the inflatable product body is further provided with a manual inflation and deflation valve.

A production method for the inflatable product includes the following steps:

Step 1. Providing a through hole on the inflatable product body for embedding the lower shell;

Step 2. Embedding the lower shell at the through hole. The fused edge abuts against the outer wall of the inflatable product body;

Step 3. Sealingly connecting the fused edge with the inflatable product body by a fusion process; and Step 4. Assembling the air pump body in the lower shell, and then assembling the waterproof upper cover on the lower shell in sealed connection.

A utilizing method for the inflatable product includes the following methods:

① A method for inflating the inflatable product: Opening the waterproof upper cover. At this time, the air pump body and the lower shell are assembled and connected. Starting the air pump body to inflate the inflatable product. After the inflation is completed, turning off the air pump body and sealingly connecting the waterproof upper cover to the lower shell.

② A method for inflating a plurality of inflatable products with single air pump body: Arranging the plurality of inflatable products with the lower shell and the waterproof upper cover, respectively. Configuring the plurality of inflatable products with one air pump body. Inflating the inflatable product to be inflated by disassembling the air pump body from the lower shell of the current inflatable product and assembling the air pump body on the lower shell of the inflatable product to be inflated. After the inflation is completed, sealingly connecting the waterproof upper cover to the lower shell.

③ A method for inflating other inflatable products: Disassembling the air pump body from the lower shell of the inflatable product and connecting the first air outlet of the air pump body to the air inlets of other inflatable products through an air nozzle to inflate the other inflatable products.

Based on the above description of the present invention compared with the prior art, the advantages of the present invention are as follows:

First, the air pump body of the waterproof air pump can be disassembled and separated integrally relative to the waterproof shell, and the air pump body can be placed inside the inflatable product, which realizes waterproofing and simultaneously facilitate to repair, charge, and replace the air pump body. One air pump body can be configured with a plurality of inflatable products to use and inflate various inflatable products by connecting an air nozzle, which makes the air pump body flexible and convenient to use and reduce costs. Meanwhile, thread connection, screw fastening connection and other quick connection methods are adopted to connect the lower shell with the waterproof upper cover and connect the air pump body and the lower shell, so it is convenient and quick to assemble and disassemble and the connection between parts is stable, reducing the manufacturing difficulties.

Second, the sealed connection between the lower shell and the waterproof upper cover can achieve a sufficient waterproof and prevent air leakage. At the same time, by connecting the one-way sealing valve piece to the second air outlet of the lower shell, double sealing is achieved and air leakage is prevented more effectively.

Third, by providing ventilation slots at the bottom end surface of the lower shell, the air outlet can always communicate with the inner cavity of the inflatable product, effectively preventing a situation that the air pump is not capable of inflating when it is placed on a flat surface.

Fourth, by arranging the fused edge connection slot seat on the outer wall of the lower shell and embedding the fused edge, it is convenient to sealingly connect the waterproof air pump with the inflatable product through the fusion process.

Fifth, the inflatable product is further arranged with a manual inflation and deflation valve. When the waterproof air pump does not work, the inflatable product can be inflated through the manual inflation and deflation valve, providing an emergency backup inflation method for the inflatable product. At the same time, the inflatable product can also be deflated quickly through the manual inflation and deflation valve to facilitate storing the inflatable product.

Figure 1:
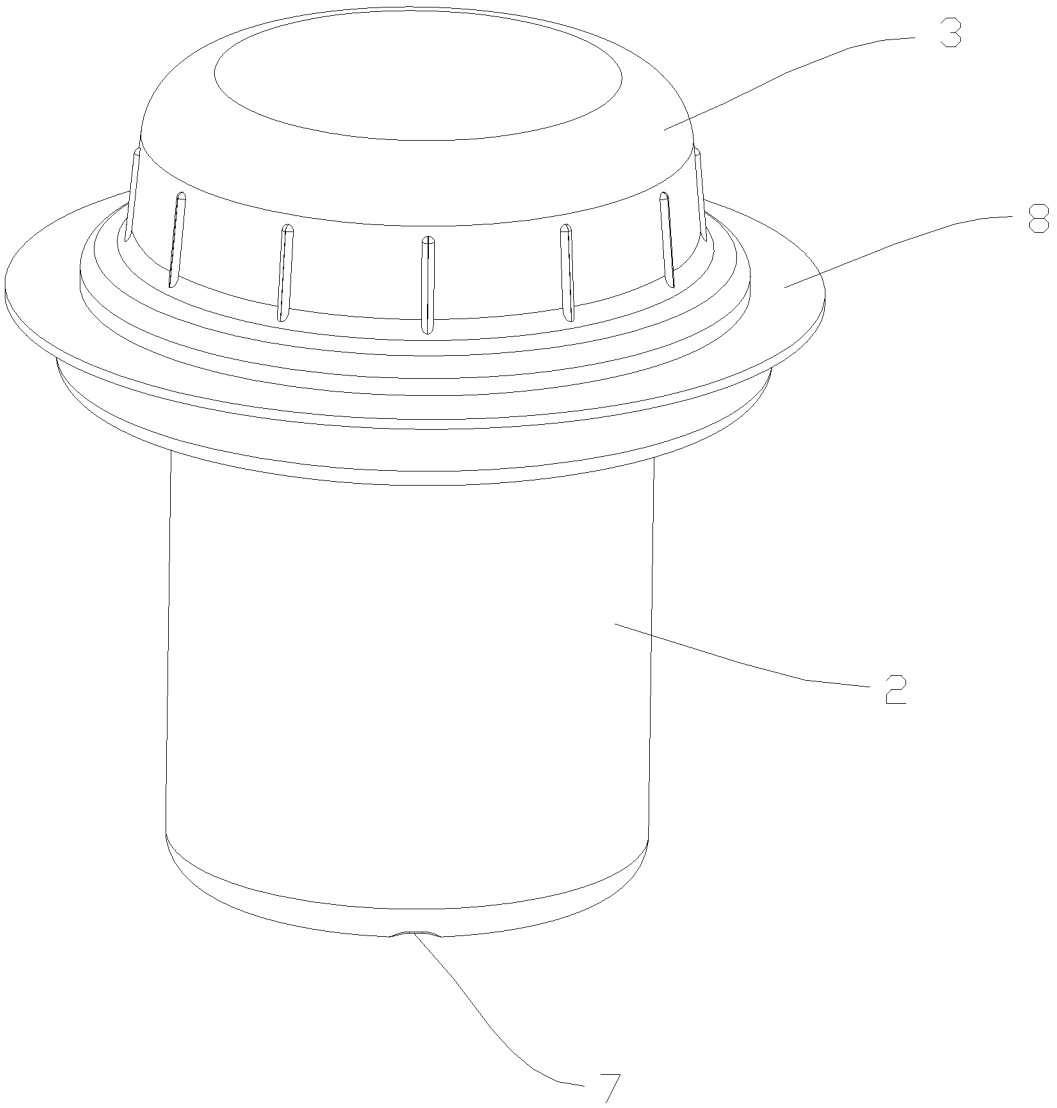
FIG. 1 is a perspective view showing an installation structure of a waterproof air pump according to Embodiment I of the present invention.
Figure 2:
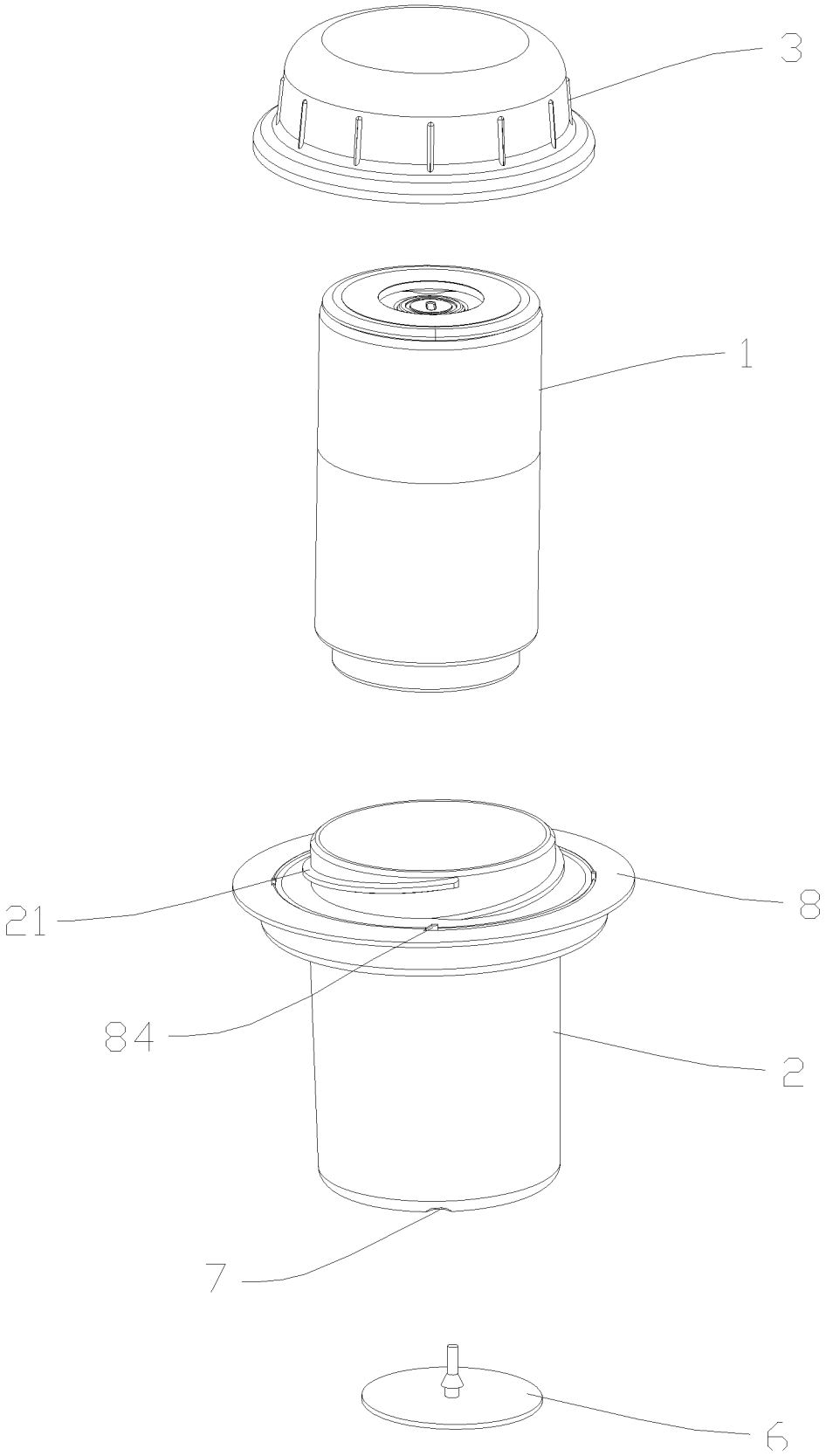
FIG. 2 is an exploded view of the waterproof air pump according to Embodiment I of the present invention.
Figure 3:
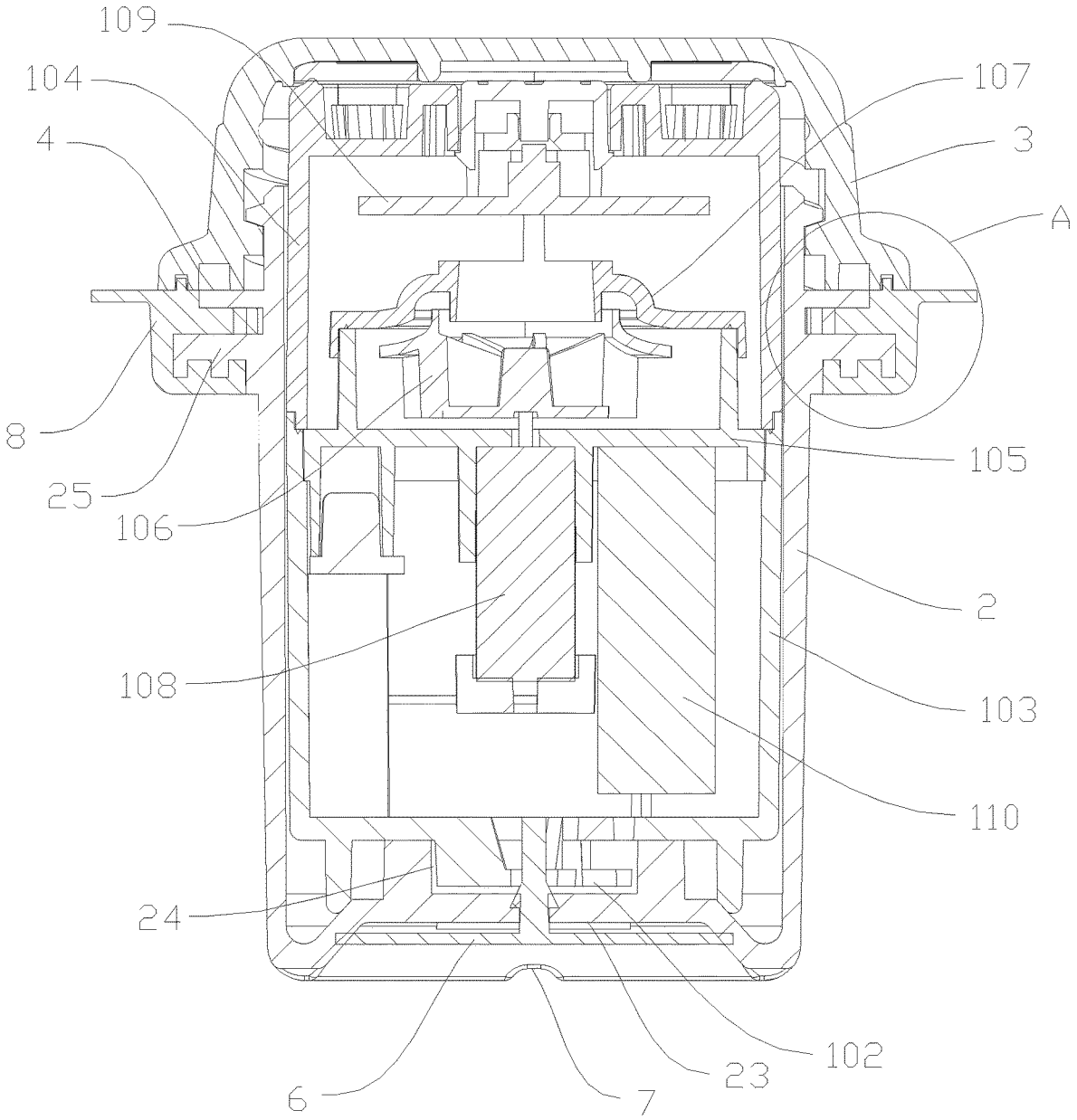
FIG. 3 is a cross section view of the waterproof air pump according to Embodiment I of the present invention.
Figure 4:
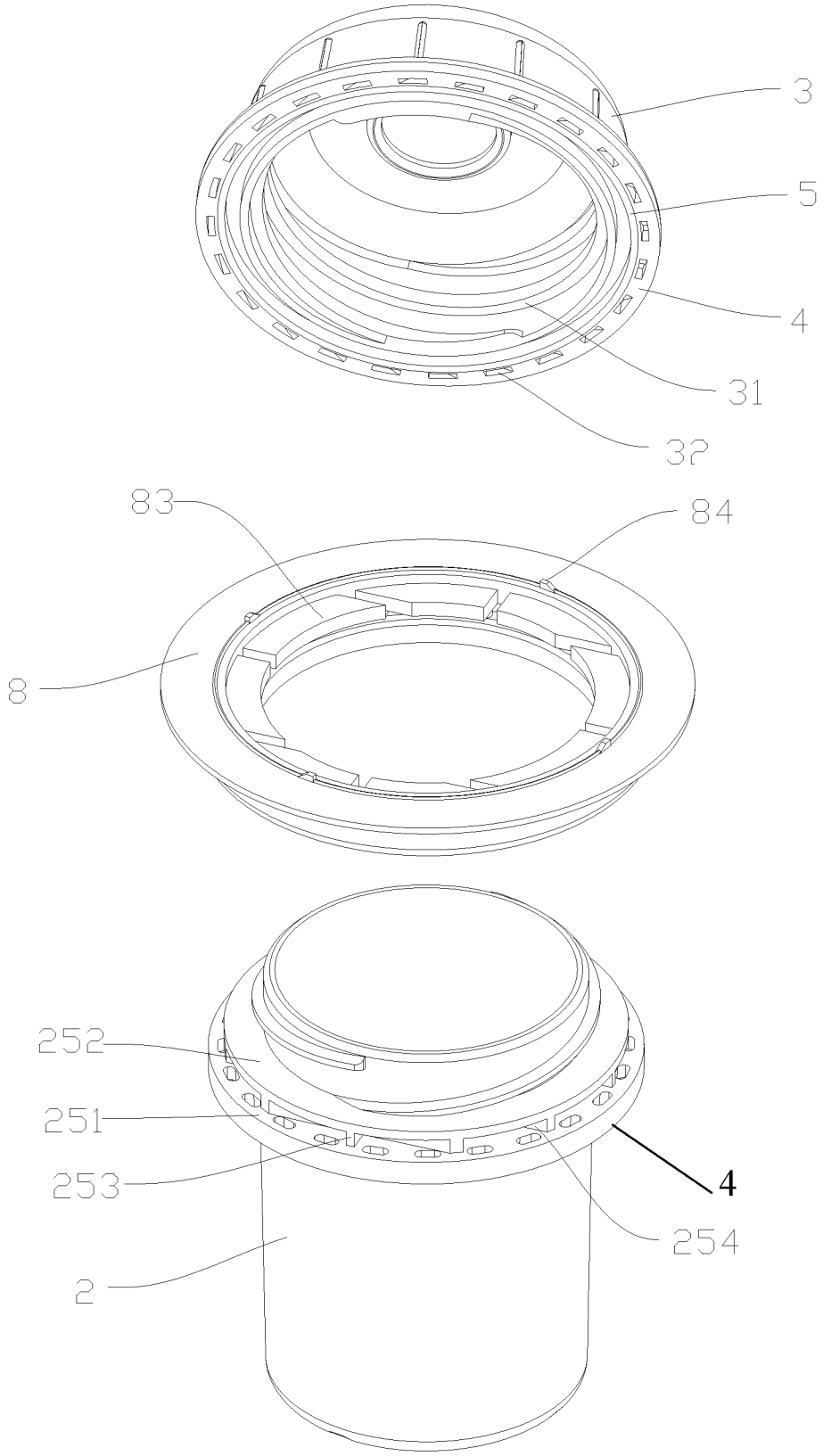
FIG. 4 is an exploded view of a partial structure of the waterproof air pump according to Embodiment I of the present invention.
Figure 5:
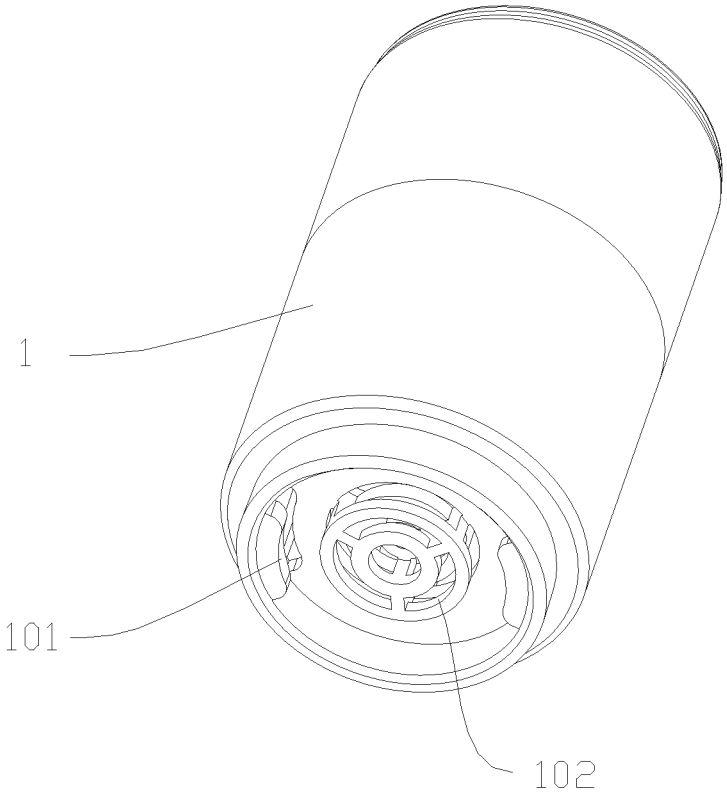
FIG. 5 is a perspective view of an air pump body according to Embodiment I of the present invention.
Figure 6:
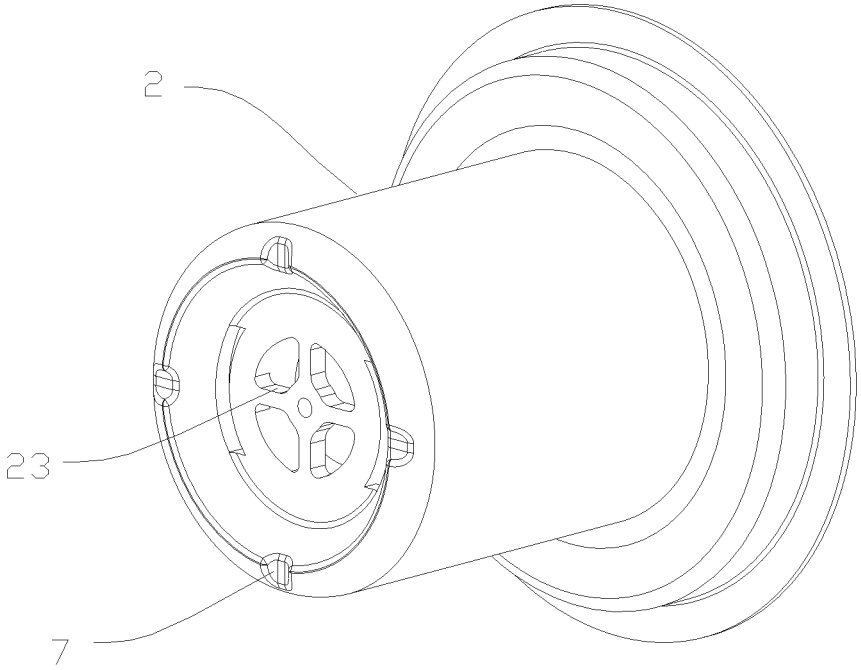
FIG. 6 is a perspective view of a lower shell according to Embodiment I of the present invention.
Figure 7:
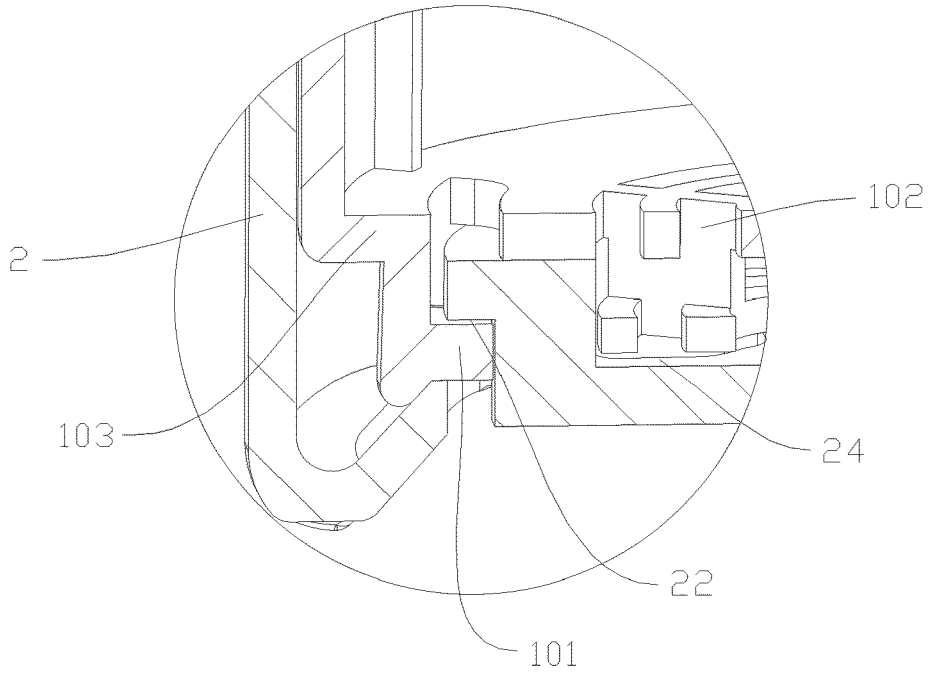
FIG. 7 is a cross section view of a partial structure of the waterproof air pump according to Embodiment I of the present invention, showing a screw fastening connection structure between the air pump body and the lower shell.
Figure 8:
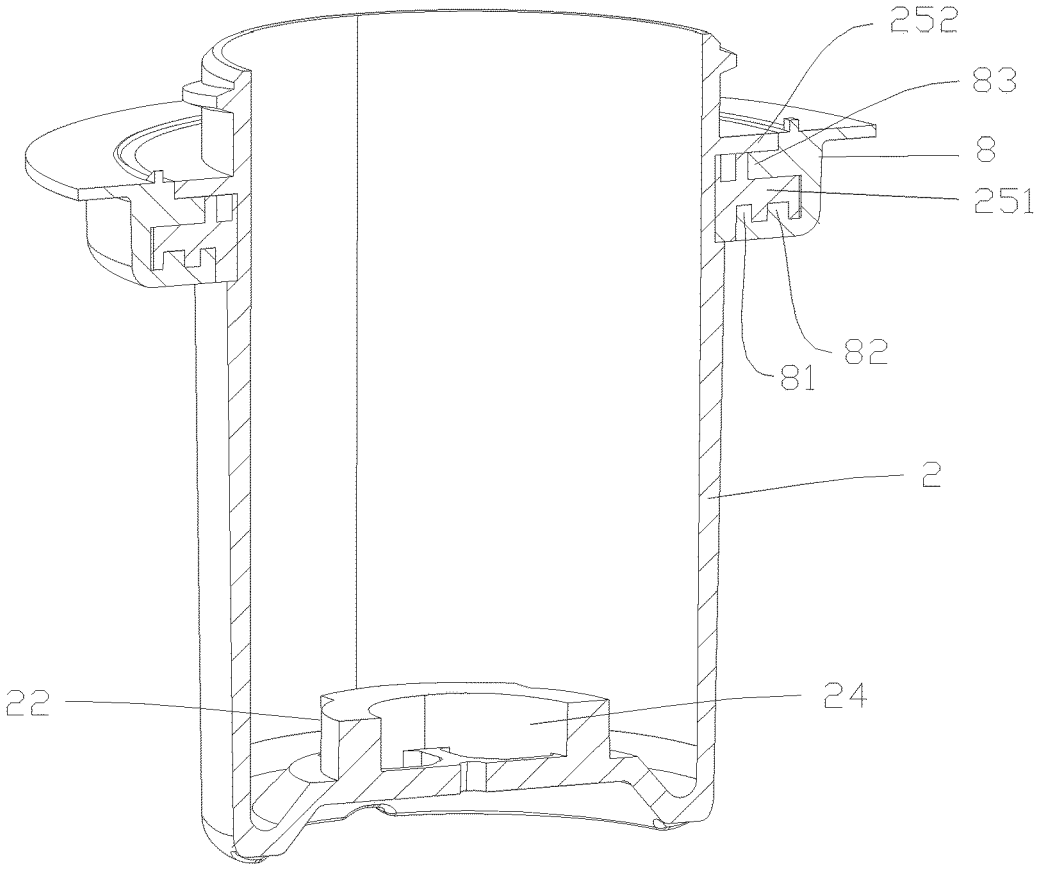
FIG. 8 is a cutaway view showing the lower shell and a fused edge according to Embodiment I of the present invention.
Figure 9:
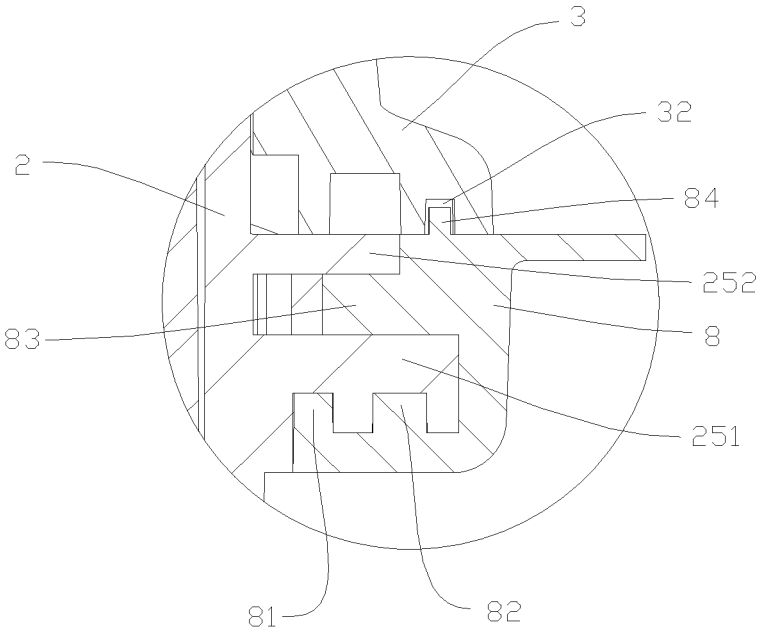
FIG. 9 is an enlarged view at A in FIG. 3.
Figure 10:
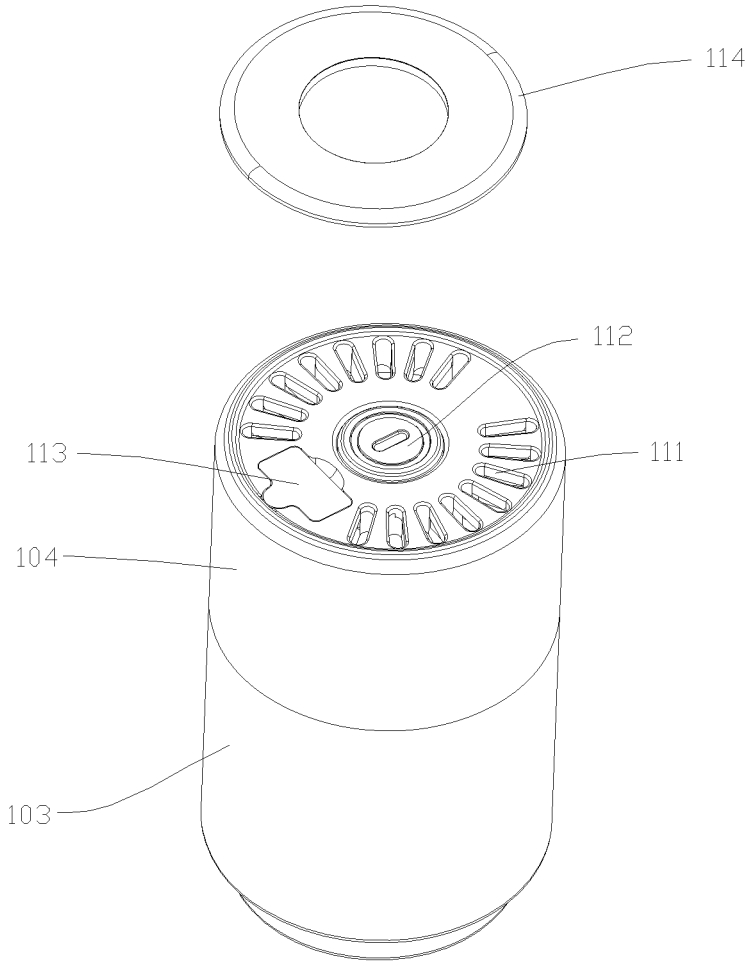
FIG. 10 is an exploded view of the air pump body according to Embodiment I of the present invention.

1—air pump body, 101—first fastening member, 102—first air outlet, 103—air pump shell, 104—air pump upper cover, 105—motor bracket, 106—impeller, 107—impeller cover, 108—motor, 109—circuit board, 110—lithium battery, 111—air inlet mesh hole, 112—switch button, 113—charging port, 114—top cover 115—air pump lower shell, 116—air pump upper shell, 117—upper mounting bracket, 118—lower mounting bracket, 119—indicator light, 2—lower shell, 21—outer thread, 22—first guide chute, 23—second air outlet, 24—groove, 25—fused edge connection slot seat, 251—lower ring plate, 252—upper ring plate, 253—connecting rib, 254—inserting slot, 255—inner ring, 256—outer ring, 257—hollow connecting ring, 258—intermediate connecting part, 3—waterproof upper cover, 31—inner thread, 32—clamping slot, 4—flat sealing surface, 5—seal ring, 6—one-way sealing valve piece, 7—ventilation slot, 8—fused edge, 81—first embedding lug, 82—second embedding lug, 83—inserting block, 84—clamping block, 85—third embedding lug, 9—inflatable swim ring, 91—manual inflation and deflation valve, 10—second guide chute, 11—second fastening member, 1101—transition ramp, 1102—stop block, 12—third guide chute, 1201—limiting protruding part, 13—third fastening member.

DETAILED DESCRIPTION OF THE EMBODIMENTS

The present invention is further described as follows by means of specific embodiments.

Embodiment I

As shown in FIGS. 1 to 10, A waterproof air pump of the present invention includes a waterproof shell and the air pump body 1 removably connected in the waterproof shell. The waterproof shell includes the lower shell 2 and the waterproof upper cover 3. The lower shell 2 and the waterproof upper cover 3 are connected through a thread in a relative sealing. The air pump body 1 and the lower shell 2 are connected through screw fastening.

The inner wall of the waterproof upper cover 3 is provided with the inner thread 31, and the outer wall of the lower shell 2 is provided with the outer thread 21 that fits with the inner thread 31. The waterproof upper cover 3 and the lower shell 2 are each formed with the flat sealing surface 4. The flat sealing surface 4 of the waterproof upper cover 3 abuts against the flat sealing surface 4 of the lower shell 2, and the seal ring 5 is provided between the two flat sealing surfaces 4 to achieve a seal between the waterproof upper cover 3 and the lower shell 2. The thread includes two large pitch threads that can reduce the time and force required to tighten and prevent unfastened situation. After the inflation reaches saturation, the waterproof upper cover 3 can be quickly tightened to achieve a sealing effect.

The air pump body 1 and the lower shell 2 are fastened and connected to each other by a screw fastening assembly. The screw fastening assembly includes the first guide chutes 22 respectively and correspondingly provided on the lower shell 2 and the air pump body 1, and the first fastening members 101 arranged in a protruding manner that fit with and is rotatably fastened into the first guide chute 22. The first guide chute 22 is provided at the lower end of the lower shell 2 around the circumference of the lower shell 2. The first fastening members 101 are provided at the lower end of the air pump body 1. The first air outlet 102 is arranged at the bottom of the air pump body 1. The second air outlet 23 is formed at the bottom of the lower shell 2 and the second air outlet 23 communicates with the first air outlet 102. The second air outlet 23 is connected to the one-way sealing valve piece 6, which can effectively prevent air leakage. The first air outlet 102 of the air pump body 1 is cylindrical and arranged in a protruding manner toward the lower end. The upper end of the second air outlet 23 of the lower shell 2 is formed with the groove 24, and the groove 24 matches the shape of the first air outlet 102 of the air pump body 1. The first air outlet 102 is embedded in the groove 24, and abuts against and communicates with the second air outlet 23. The bottom end surface of the lower shell 2 is formed with four equally spaced ventilation slots 7, and the four ventilation slots 7 are arranged through the bottom end surface of the lower shell 2 along the radial direction. One end of each of the ventilation slots 7 communicates with the second air outlet 23, and the other end of each of the ventilation slots 7 communicates with the outside of the lower shell 2.

The air pump body 1 is an inflatable pump, and the air pump body 1 includes the air pump shell 103, the air pump upper cover 104, the motor bracket 105 arranged between the air pump shell 103 and the air pump upper cover 104, the impeller 106, the impeller cover 107, the motor 108, the circuit board 109, and the lithium battery 110 for supplying power to the motor 108 and the circuit board 109. The air pump shell 103 is restrictively clamped to the air pump upper cover 104, and the motor bracket 105 is clamped on the air pump shell 104. The impeller 106 is rotatably arranged between the motor bracket 105 and the impeller cover 107. The motor 108 is connected to and drives the impeller 106 to rotate. The air inlet mesh holes 111, the switch button 112, and the charging port 113 are provided at the top of air pump upper cover 104. The indicator light is provided at the bottom of the air pump upper cover 104 and glows through the transparent air pump upper cover 104. The air pump upper cover 104 is further provided with the top cover 114. The motor 108, the lithium battery 110, the switch button 112 and the charging port 113 are all electrically connected to the circuit board 109, forming the electrical system of the air pump body 1. The motor 108 and the lithium battery 110 are fixedly arranged below the motor bracket 105, and the circuit board 109 is fixedly arranged above the impeller cover 107. In addition, it should be noted that the structure of the air pump body 1 is not limited to this, and the inflatable pump with any structure that achieves the inflatable function can be adopted. The air pump body 1 has the compact structure, small size, and high inflation efficiency.

The outer wall of the lower shell 2 is provided with the fused edge connection slot seat 25 and the fused edge 8 embedded on the fused edge connection slot seat 25. The fused edge 8 is used to connect and seal the lower shell 2 with the inflatable product. The fused edge connection slot seat 25 includes the lower ring plate 251 and the upper ring plate 252 fixedly connected to the outer wall of the lower shell, and a plurality of connecting ribs 253 connected between the lower ring plate 251 and the upper ring plate 252. the plurality of connecting ribs 223 are arranged at intervals, and a plurality of inserting slots 254 are formed between the lower ring plate 251 and the upper ring plate 252. The lower ring plate 251 is formed with the first embedding slot and the second embedding slot. The fused edge 8 is wrapped around the lower ring plate 251 from the outer end and formed with the first embedding lug 81 and the second embedding lug 82 which can be inserted into the first embedding slot and the second embedding slot, respectively, and a plurality of inserting blocks 83 which can be correspondingly inserted into the plurality of inserting slots 254 is formed. The inserting blocks 83 are pressed between the upper ring plate 252 and the lower ring plate 251. This installation structure formed by the fused edge connection slot seat 25 and fused edge 8 achieves horizontal limit by means of the cooperation between the first and second embedding slots and the first and second embedding lugs and achieves a longitudinal limit by pressing the inserting blocks 83 in the inserting slots 254 between the upper ring plate 252 and the lower ring plate 251, leading to a more stable installation structure and higher connection strength. The fused edge connection slot seat 25 is made of rigid plastic. The fused edge 8 is made of soft rubber. The fused edge connection slot seat 25 is molded by injection molding, and the fused edge 8 is molded and connected to the fused edge connection slot seat 25 by injection molding. In addition, it should be noted that the structure of the fused edge connection slot seat 25 and the fused edge 8 is not limited to this. Any embedded structure that achieves the connection of the fused edge connection slot seat 25 and the fused edge 8 can be adopted. The upper end surface of the fused edge 8 is provided with a plurality of clamping blocks 84 circumferentially, and the lower end of the waterproof upper cover 3 is provided with a plurality of clamping slots 32 circumferentially. The clamping blocks 84 are clamped in the clamping slots 32 to prevent the loosening of the threads.

Figure 11:
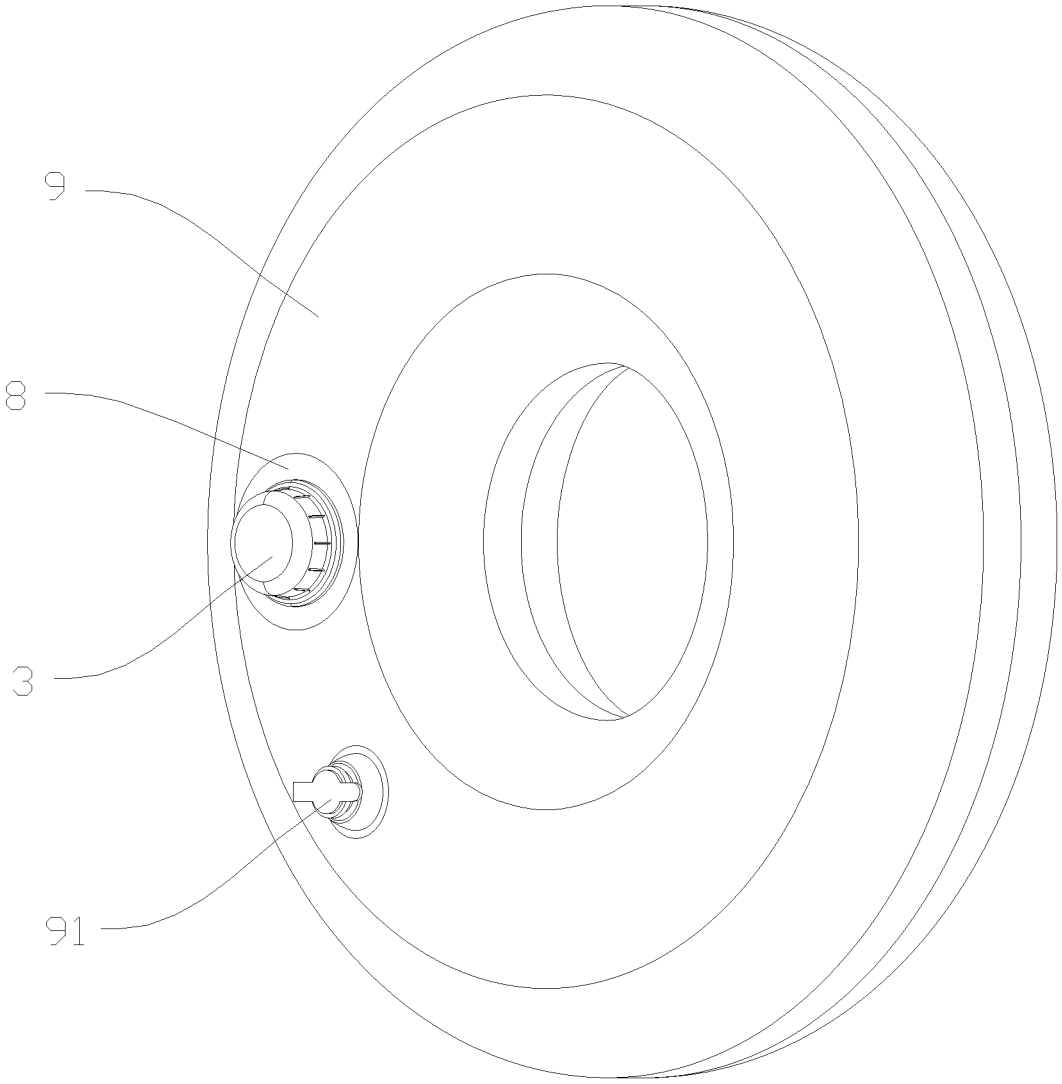
FIG. 11 is a perspective view of an inflatable swim ring according to Embodiment I of the present invention.
Figure 12:
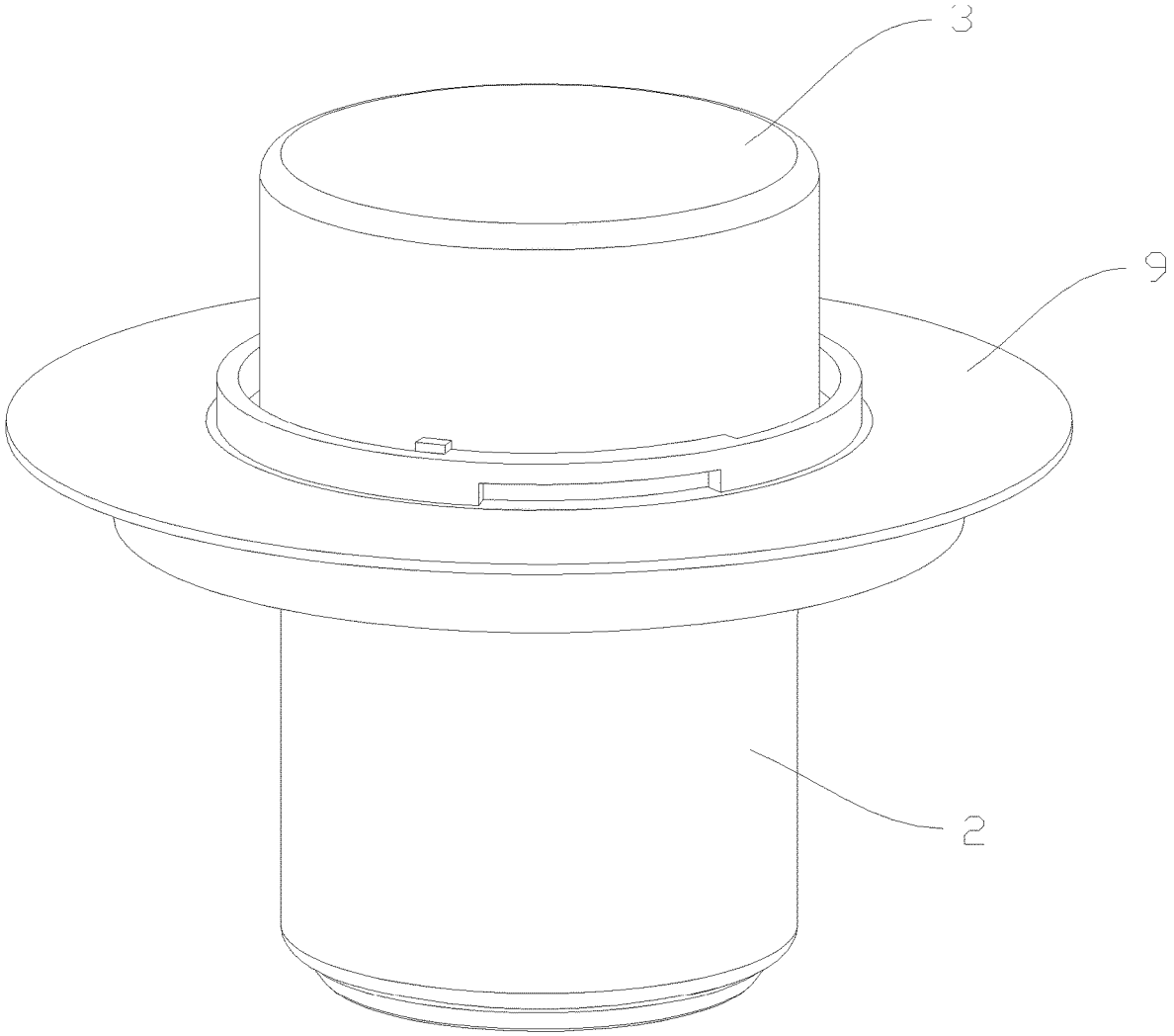
FIG. 12 is a perspective view showing an installation structure of a waterproof air pump according to Embodiment II of the present invention.
Figure 13:
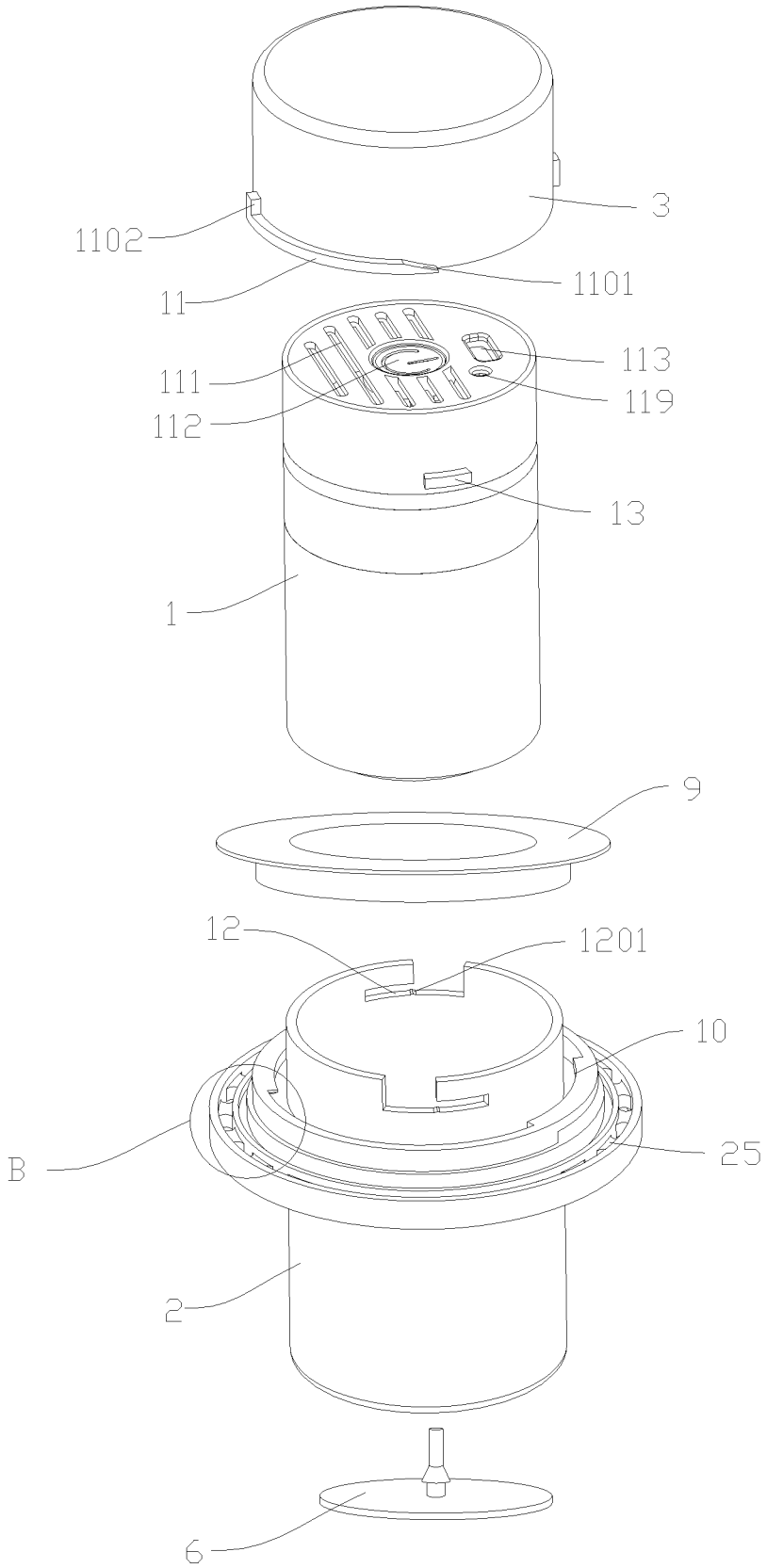
FIG. 13 is an exploded view of the waterproof air pump according to Embodiment II of the present invention.
Figure 14:
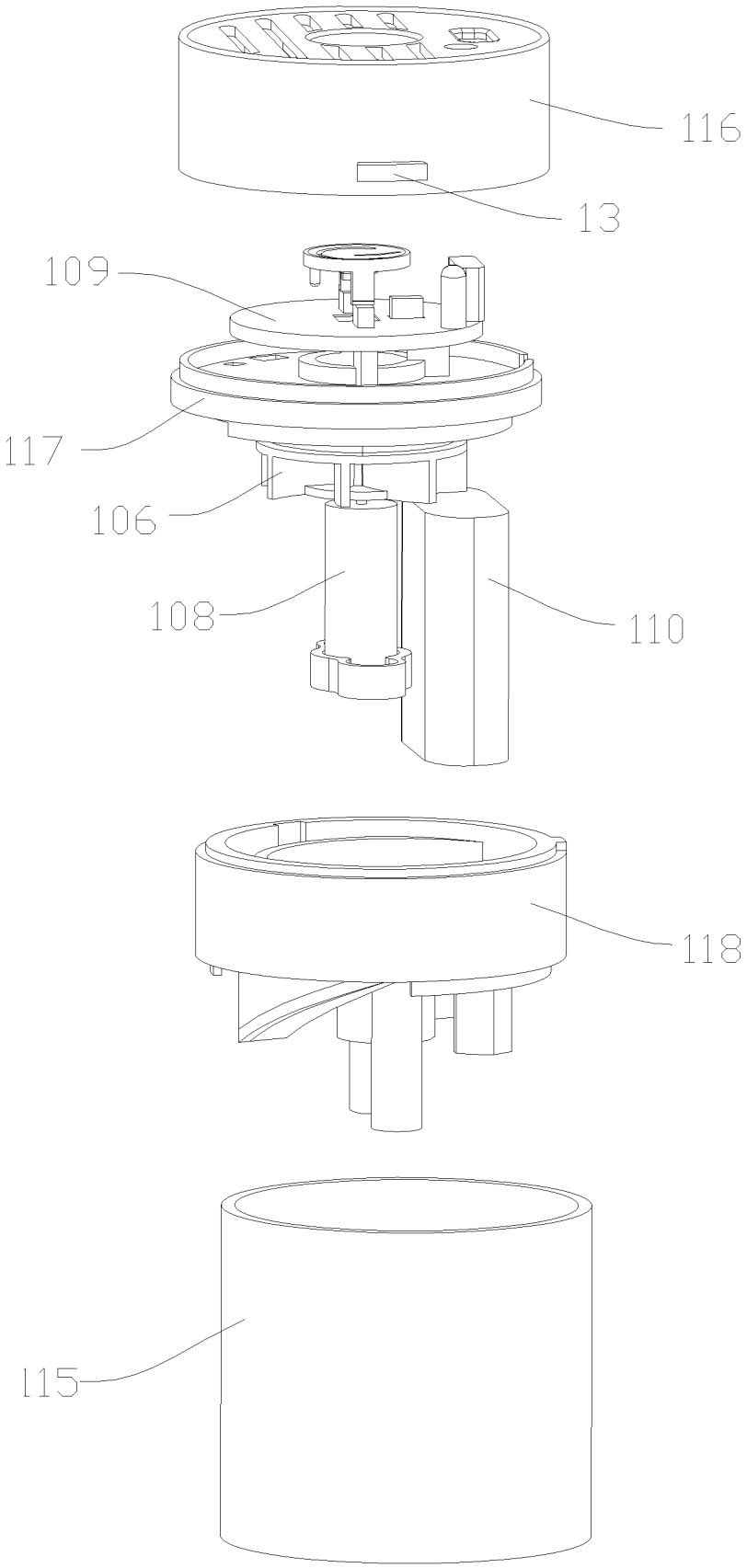
FIG. 14 is an exploded view of an air pump body according to Embodiment II of the present invention.
Figure 15:
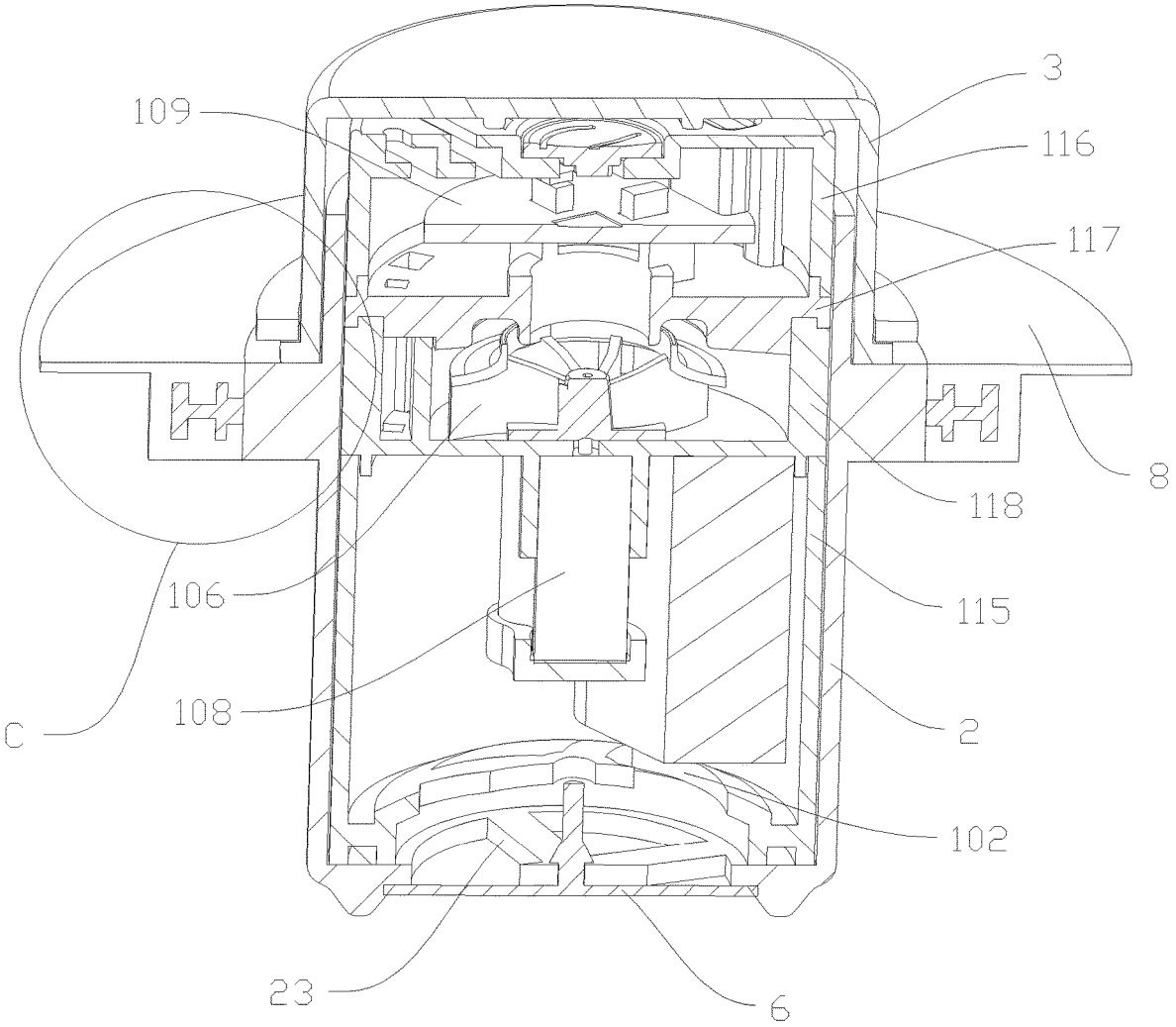
FIG. 15 is a cutaway view of the waterproof air pump according to Embodiment II of the present invention.
Figure 16:
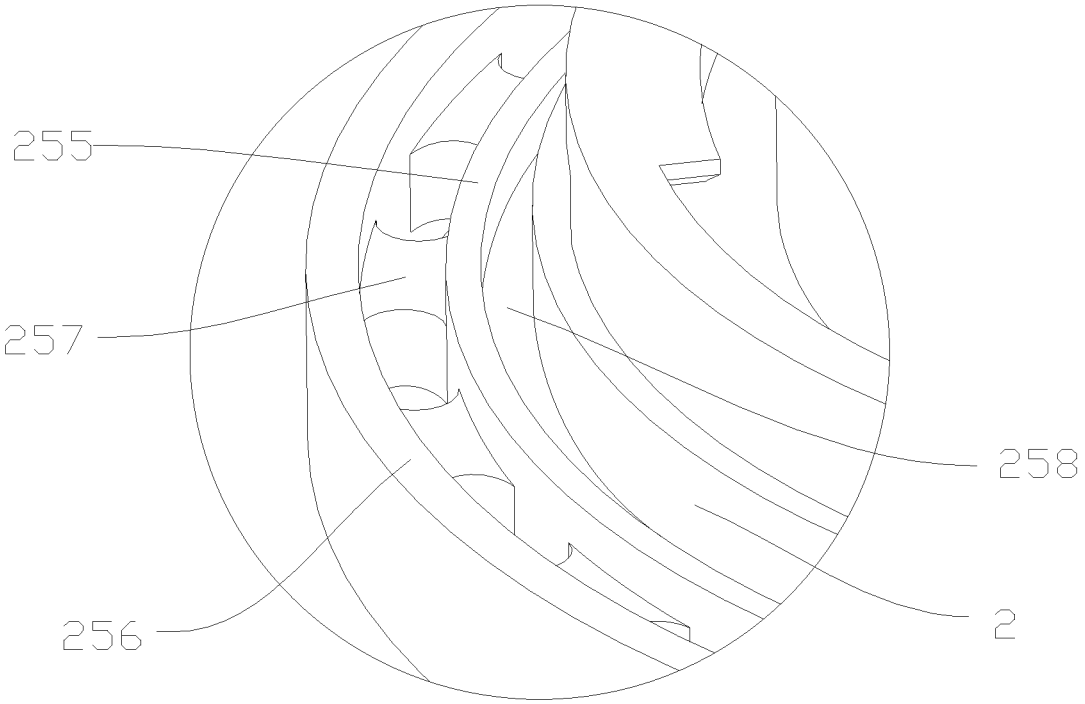
FIG. 16 is an enlarged view at B in FIG. 13.
Figure 17:
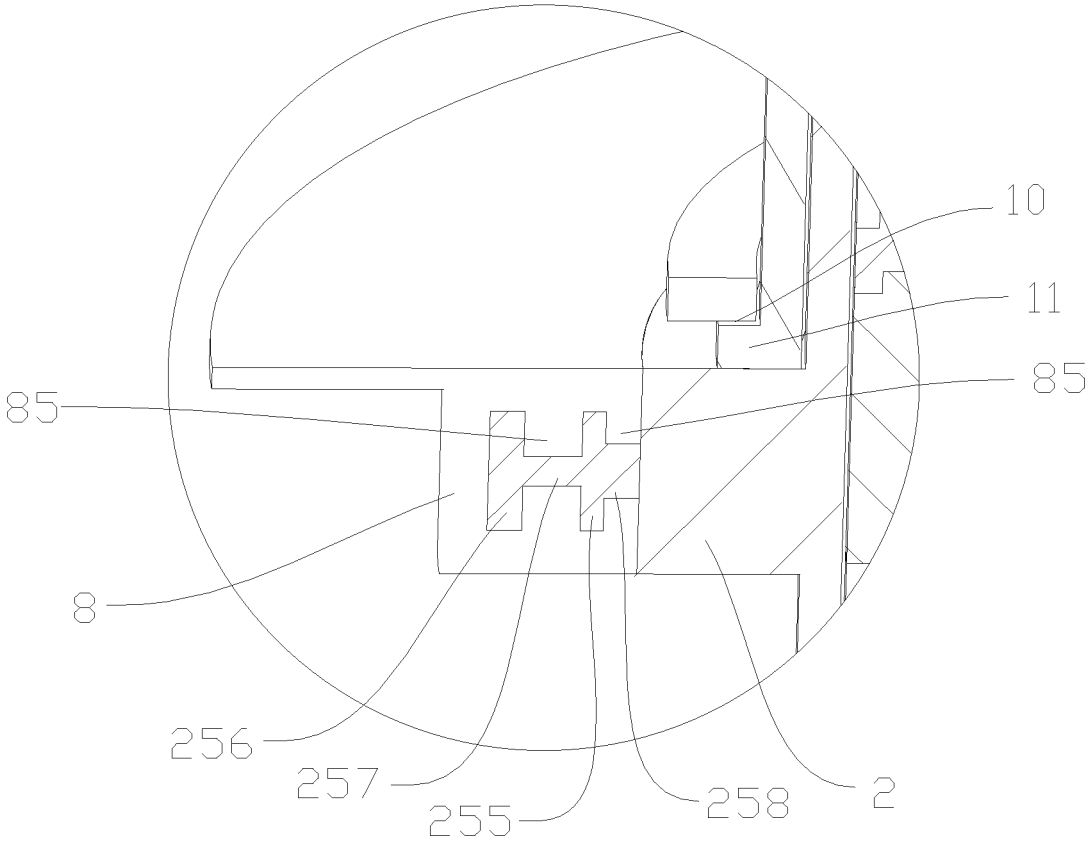
FIG. 17 is an enlarged view at C in FIG. 15.
Figure 18:
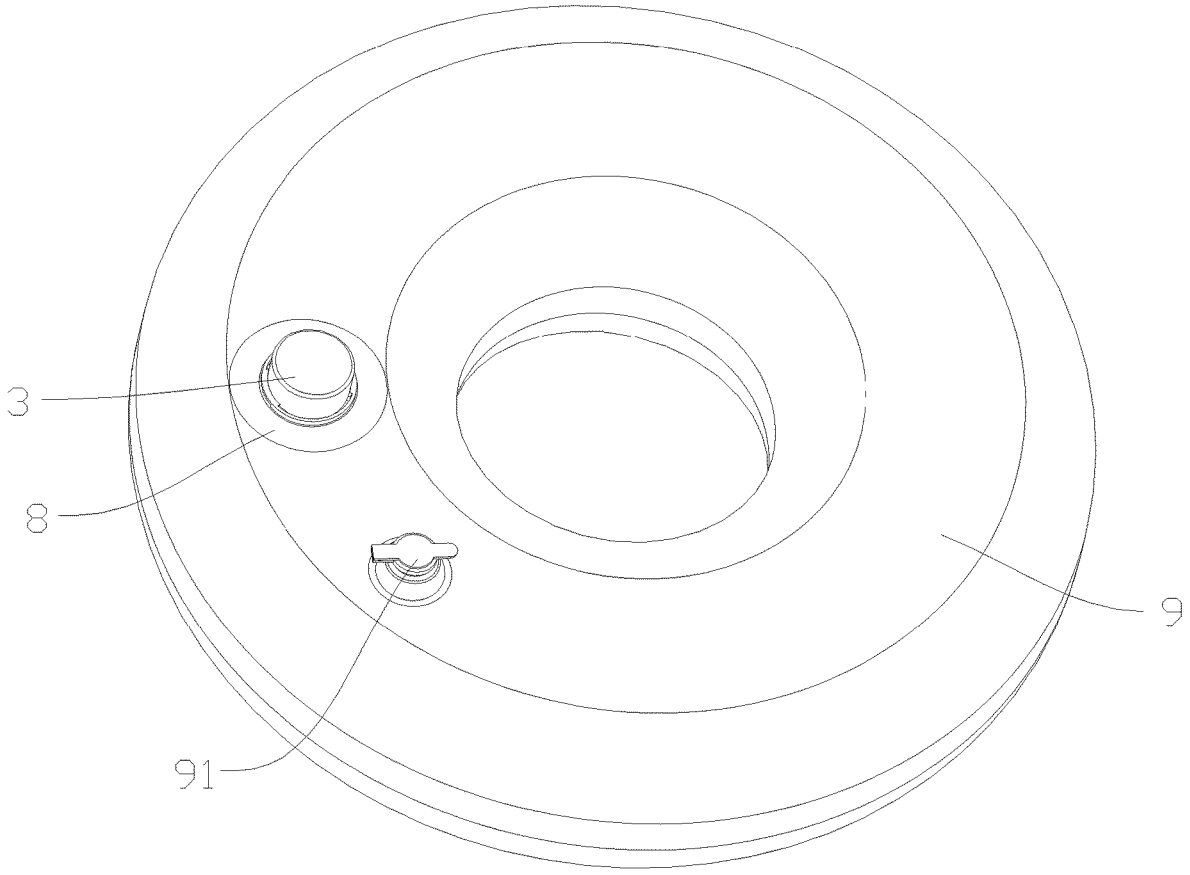
FIG. 18 is a perspective view of an inflatable swim ring according to Embodiment II of the present invention.
Figure 19:
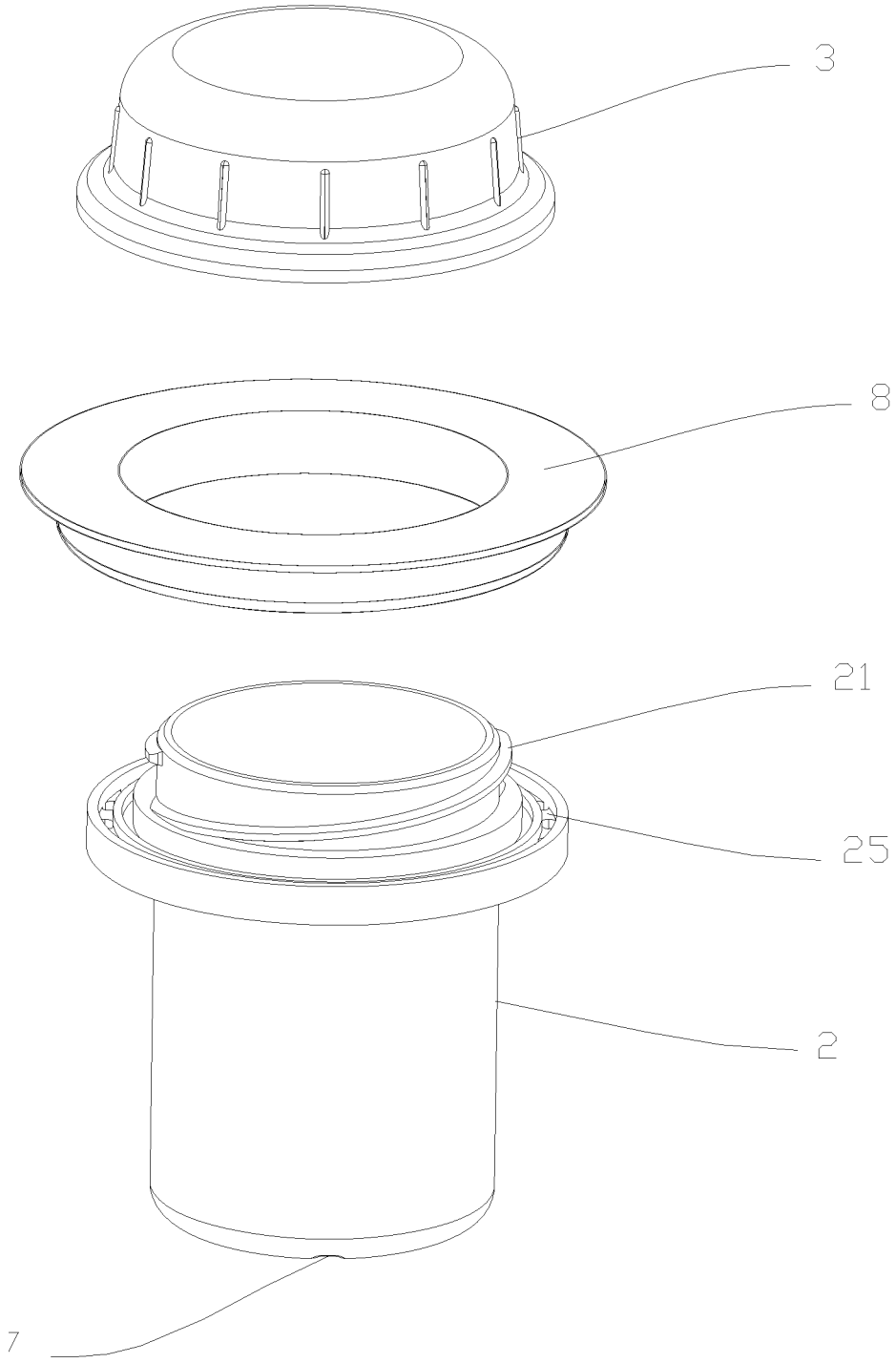
FIG. 19 is an exploded view of a partial structure of a waterproof air pump according to Embodiment III of the present invention.

As shown in FIG. 11, an inflatable product of the present invention includes an inflatable product body and the above-mentioned waterproof air pump. The inflatable product body is the inflatable swim ring 9. The outer wall of the lower shell 2 is sealingly connected to the inflatable swim ring 9 by the fused edge 8. The second air outlet 23 is located in the inner cavity of the inflatable swim ring 9, and the waterproof upper cover 3 is exposed outside the inflatable swim ring 9. The inflatable swim ring 9 is further provided with the manual inflation and deflation valve 91.

A production method for the inflatable product of the present invention includes the following steps:

Step 1. A through hole is provided on the inflatable product body for embedding the lower shell 2.

Step 2. The lower shell 2 is embedded at the through hole. The fused edge 8 abuts against the outer wall of the inflatable product body.

Step 3. The fused edge 8 is sealingly connected to the inflatable product body by the fusion process.

Step 4. The air pump body 1 is assembled in the lower shell 2, and then the waterproof upper cover 3 is assembled on the lower shell 2 in the sealed connection.

A utilizing method for the inflatable product of the present invention includes the following methods.

① A method for inflating the inflatable product: The waterproof upper cover 3 is opened. At this time, the air pump body 1 and the lower shell 2 are assembled and connected. The air pump body 1 is started to inflate the inflatable product. After the inflation is completed, the air pump body 1 is turned off, and the waterproof upper cover 3 is sealingly connected onto the lower shell 2.

② A method for inflating a plurality of inflatable products with single air pump body: The plurality of inflatable products is arranged with the lower shell 2 and waterproof upper cover 3, respectively. The plurality of inflatable products is configured with one air pump body 1. The inflatable product to be inflated is inflated by disassembling the air pump body 1 from the lower shell 2 of the current inflatable product and assembling the air pump body 1 on the lower shell 2 of the inflatable product to be inflated. After the inflation is completed, the waterproof upper cover 3 is sealingly connected to the lower shell 2.

③ A method for inflating other inflatable products: The air pump body 1 is disassembled from the lower shell 2 of the inflatable product, and the first air outlet 102 of the air pump body 1 is connected to the air inlets of other inflatable products through an air nozzle to inflate other inflatable products.

Specifically, the utilizing method for the inflatable product in this embodiment is as follows: When an inflatable product needs to be inflated, the waterproof upper cover 3 is screwed off from the lower shell 2, at which time the air pump body 1 is screwed and fastened to the lower shell 2, and the air pump body 1 can be controlled to start by the switch button 112 to inflate the inflatable product. After the inflation is completed, the waterproof upper cover 3 is connected to the lower shell 2 through a thread. When the waterproof air pump does not work, the inflatable product can be inflated through the manual inflation and deflation valve 91, providing an emergency backup inflation method for the inflatable product. At the same time, the inflatable product can further be deflated quickly through the manual inflation and deflation valve 91 to facilitate storing of the inflatable product. In addition, when the single air pump body is configured with the plurality of inflatable products, the air pump body 1 is simply removed from the lower shell 2 of the current inflatable product and screwed and fastened to the lower shell 2 of the inflatable product to be inflated. When the air pump body 1 is removed from the lower shell 2, the first air outlet 102 of the air pump body 1 is connected to the air inlets of the other inflatable products through the air nozzle to inflate the other inflatable products.

Embodiment II

As shown in FIGS. 12 to 18, this embodiment differs from Embodiment I in that the waterproof air pump lower shell 2 and the waterproof upper cover 3 are fastened with each other by a screw fastening assembly, and also the air pump body 1 and the lower shell 2 are fastened with each other by a screw fastening assembly. The lower shell 2 and the waterproof upper cover 3 are relatively sealed by a seal ring arranged under the waterproof upper cover 3.

The upper end of the lower shell 2 is formed with the second guide chute 10. The lower end of the waterproof upper cover 3 is formed with the second fastening member 11 arranged in a protruding manner that fits with the second guide chute 10. The second fastening member 11 is rotatably fastened into the second guide chute 10 and interlocked with the second guide chute 10 for limiting through the stop block-fitting structure. The second guide chute is an arc-shaped through slot arranged circumferentially, and the second fastening member 11 is an arc-shaped slider that can be screwed into the arc-shaped through slot. The front end of the arc-shaped slider forms the transition ramp 1101, and the rear end of the arc-shaped slider forms a stop block 1102 that can be clamped at the end of the arc-shaped through slot.

The third guide chute 12 is formed at the upper end of the lower shell 2. The second guide chute 10 is arranged on the outer ring of the third guide chute 12. The third fastening member 13 fitted with the third guide chute 12 and arranged in a protruding manner is formed on the outer wall of the air pump body 1, and the third fastening member 13 is rotatably fastened into the third guide chute 12 and interlocked with the third guide chute 12 for limiting through the stop block-fitting structure. The third guide chute is an arc-shaped clamping slot arranged circumferentially, and the upper end of the arc-shaped clamping slot is open. The third fastening member 13 is an arc-shaped bump that can slide into the arc-shaped clamping slot from the opening at the upper end of the arc-shaped clamping slot. The arc-shaped bump slides along the guiding direction of the arc-shaped clamping slot, and the arc-shaped bump fits with the arc-shaped clamping slot through the side end surface to stop and block each other. The inner wall of the arc-shaped clamping slot is arranged with the limiting protruding part 1201 in a protruding manner. The limiting protruding part 1201 is configured to snap and fix the third fastening member 13 between the inner side thereof and the side end surface of the arc-shaped clamping slot to limit the circumferential movement of the third fastening member 13 relative to the third guide chute 12 and realize the relative locking of the third fastening member 13 and the third guide chute 12.

The air pump body 1 is an inflatable pump, and the air pump body 1 includes the air pump lower shell 215, the air pump upper shell 116, the upper mounting bracket 117, the lower mounting bracket 118, the impeller 106, the motor 108, the circuit board 109, and the lithium battery 110 for supplying power to the motor 108 and the circuit board 109. The air pump lower shell 215, the lower mounting bracket 118, the upper mounting bracket 117, and the air pump upper shell 116 are position-limiting clamped from the bottom to the top. The air inlet mesh holes 111, the switch button 112, the indicator light 119, and the charging port 113 are all arranged on top of the air pump upper shell 116. The impeller 106 is rotatably arranged between the upper mounting bracket 117 and the lower mounting bracket 118, and the upper mounting bracket 117 and the lower mounting bracket 118 are formed with gas flow channels communicating the air inlet mesh holes 111 and the first air outlet 102. The motor 108 is connected to and drives the impeller 106 to rotate. The motor 108, the lithium battery 110, the switch button 112, the indicator light 119, and the charging port 113 are all electrically connected to the circuit board 109, forming the electrical system of the air pump body 1. The motor 108 and the lithium battery 110 are fixedly arranged under lower mounting bracket 118, and the circuit board 109 is fixedly arranged over the upper mounting bracket 117. The air pump body 1 has a compact structure, small size, and high inflation efficiency.

The fused edge connection slot seat 25 includes the inner ring 255, the outer ring 256, and the hollow connecting ring 257 connected between the inner ring 255 and the outer ring 256. The inner ring 255 is fixedly connected onto the outer wall of the lower shell 2 through the intermediate connecting part 258. The first upper embedding slot and the first lower embedding slot are formed at the upper and lower sides of the hollow connecting ring 257, respectively between the inner ring 255 and the outer ring 256. The second upper embedding slot and the second lower embedding slot are formed at the upper and lower sides of the intermediate connecting part 258, respectively between the inner ring 255 and the outer wall of the lower shell 2. The fused edge 8 is arranged to wrap the outer ring 256 and the inner ring 255 from the outer end and form four third embedding lugs 85 that can be fitted to embed in the first upper embedding slot, the first lower embedding slot, the second upper embedding slot, and the second lower embedding slot, respectively. The four third embedding lugs 85 simultaneously cooperate to fill the hollow part of the hollow connecting ring 257.

Embodiment III

This embodiment differs from Embodiment I in that the fused edge connection slot seat 25 includes the inner ring 255, the outer ring 256, and the hollow connecting ring 257 connected between the inner ring 255 and the outer ring 256. The inner ring 255 is fixedly connected onto the outer wall of the lower shell 2 through the intermediate connecting part 258. The first upper embedding slot and the first lower embedding slot are formed at the upper and lower sides of the hollow connecting ring 257, respectively between the inner ring 255 and the outer ring 256. The second upper embedding slot and the second lower embedding slot are formed at the upper and lower sides of the intermediate connecting part 258, respectively between the inner ring 255 and the outer wall of the lower shell 2. The fused edge 8 is arranged to wrap the outer ring 256 and the inner ring 255 from the outer end and form four third embedding lugs 85 that can be fitted to embed in the first upper embedding slot, the first lower embedding slot, the second upper embedding slot, and the second lower embedding slot, respectively. The four third embedding lugs 85 simultaneously cooperate to fill the hollow part of the hollow connecting ring 257. The inflatable product is an inflatable boat.

Embodiment IV

This embodiment differs from Embodiment I in that the lower shell 2 of the waterproof air pump and the waterproof upper cover 3 are connected by the thread, and the air pump body 1 and the lower shell 2 are connected by the thread. The upper end of the inner wall of the lower shell 2 is provided with an inner thread simultaneously, and the outer wall of the air pump body 1 is provided with an outer thread that match the inner thread of the inner wall of the lower shell 2. The inflatable product is an inflatable swimming pool.

Embodiment V

This embodiment differs from Embodiment I in that the lower shell 2 of the waterproof air pump is connected to the waterproof upper cover 3 by the thread. The air pump body 1 is connected to the lower shell 2 by the screw fastening assembly. The upper end of the lower shell 2 is provided with the guide chute, and the fastening member that matches with the guide chute is arranged on the outer wall of the air pump body 1 in the protruding manner. The ring wall where the outer thread of the lower shell 2 is located is arranged on the outer ring of the ring wall where the guide chute is located.

The above description is only five specific embodiments of the present invention, but the design concept of the present invention is not limited herein. Any non-substantial modification of the present invention based on the concept shall fall in the scope of protection of the present invention.

What claimed is:

1. A waterproof air pump, comprising:

a waterproof shell and an air pump body, wherein the air pump body is removably connected in the waterproof shell;

the waterproof shell comprises a lower shell and a waterproof upper cover;

the lower shell and the waterproof upper cover are removably connected forming a sealed connection;

the air pump body and the lower shell are removably connected;

the air pump body is provided with a first air outlet, the first air outlet comprising a raised substantially cylindrical protuberance extending from a bottom of the air pump body, and a second air outlet is formed in the lower shell, an inside of the lower shell having a raised substantially circular wall around a perimeter of an inside of the second air outlet, the raised substantially circular wall having a perimeter greater than a perimeter of the raised substantially cylindrical protuberance, wherein the first air outlet includes air flow apertures disposed on both a bottom and a substantially cylindrical side of the substantially cylindrical protuberance and wherein the substantially circular wall is disposed directly adjacent to the air flow apertures on the substantially cylindrical side of the substantially cylindrical protuberance; and the second air outlet communicates with the first air outlet, the substantially cylindrical protuberance fitting inside the raised substantially circular wall.

2. The waterproof air pump according to claim 1, wherein at least a portion of the substantially circular wall is disposed at a same height as the air flow apertures on the substantially cylindrical side of the substantially cylindrical protuberance.

3. The waterproof air pump according to claim 1, wherein the lower shell and the waterproof upper cover are connected to each other through a first thread, and the lower shell and the air pump body are fastened with each other by a screw fastening assembly.

4. The waterproof air pump according to claim 3, wherein the screw fastening assembly comprises:

a guide chute provided on a connecting part; and a fastening member arranged in a protruding manner, wherein the fastening member fits with the guide chute and the fastening member is rotatably fastened in the guide chute.

5. The waterproof air pump according to claim 1, wherein the second air outlet in the lower shell is connected to a one-way sealing valve piece.

6. The waterproof air pump according to claim 1, wherein a bottom end surface of the lower shell is formed with a plurality of ventilation slots; and the plurality of ventilation slots are arranged through the bottom end surface of the lower shell, wherein a first end of each of the plurality of ventilation slots communicates with the second air outlet, and a second end of each of the plurality of ventilation slots communicates with an outside of the lower shell.

7. The waterproof air pump according to claim 6, wherein the plurality of ventilation slots are evenly spaced and arranged in a circular pattern.

8. The waterproof air pump according to claim 1, wherein an outer wall of the lower shell is provided with a fused edge connection slot seat and a fused edge, wherein the fused edge is embedded on the fused edge connection slot seat; and the fused edge is configured to connect and seal the lower shell with an inflatable product.

9. An inflatable product, comprising an inflatable product body and the waterproof air pump according to claim 1, wherein an outer wall of the lower shell is sealingly connected to the inflatable product body;

the second air outlet is located in an inner cavity of the inflatable product body; and the waterproof upper cover is exposed outside the inflatable product body.

10. The inflatable product according to claim 9, wherein the inflatable product body is further provided with a manual inflation and deflation valve.

11. The inflatable product according to claim 9, wherein in the waterproof air pump, the lower shell and the waterproof upper cover are connected to each other through a first thread, and the lower shell and the air pump body are fastened with each other by a screw fastening assembly.

12. The inflatable product according to claim 11, wherein in the waterproof air pump, the screw fastening assembly comprises;

a guide chute provided on a connecting part, and a fastening member arranged in a protruding manner, wherein the fastening member fits with the guide chute and the fastening member is rotatably fastened in the guide chute.

13. The inflatable product according to claim 9, wherein in the waterproof air pump, the second air outlet in the lower shell is connected to a one-way sealing valve piece.

14. The inflatable product according to claim 9, wherein in the waterproof air pump, a bottom end surface of the lower shell is formed with a plurality of ventilation slots; and the plurality of ventilation slots are arranged through the bottom end surface of the lower shell, wherein a first end of each of the plurality of ventilation slots communicates with the second air outlet, and a second end of each of the plurality of ventilation slots communicates with an outside of the lower shell.

15. The inflatable product according to claim 9, wherein in the waterproof air pump, the outer wall of the lower shell is provided with a fused edge connection slot seat and a fused edge, wherein the fused edge is embedded on the fused edge connection slot seat; and the fused edge is configured to connect and seal the lower shell with the inflatable product.

16. A production method of producing the inflatable product of claim 9, comprising the following steps:

step 1: providing a through hole on the inflatable product body for embedding the lower shell;

step 2: embedding the lower shell at the through hole, wherein a fused edge abuts against an outer wall of the inflatable product body;

step 3: sealingly connecting the fused edge with the inflatable product body by a fusion process; and step 4: assembling the air pump body in the lower shell, and assembling the waterproof upper cover on the lower shell in a sealed connection.

17. The production method according to claim 16, wherein in the inflatable product, the inflatable product body is further provided with a manual inflation and deflation valve.

18. A utilizing method for the inflatable product according to claim 9, comprising one of the following methods:

① a method for inflating the inflatable product: opening the waterproof upper cover; wherein, the air pump body and the lower shell are assembled and connected; starting the air pump body to inflate the inflatable product; after an inflation is completed, turning off the air pump body; and sealingly connecting the waterproof upper cover to the lower shell;

② a method for inflating a plurality of inflatable products with one air pump body, wherein the inflatable product is part of the plurality of inflatable products: arranging each one of the plurality of inflatable products with the lower shell and the waterproof upper cover, respectively; configuring the plurality of inflatable products with the one air pump body;

inflating one of the plurality of inflatable products by disassembling the one air pump body from the lower shell of a current inflatable product and assembling the one air pump body on the lower shell of the one of the plurality of inflatable products; and after the inflation is completed, sealingly connecting the waterproof upper cover to the lower shell; or ③ a method for inflating other inflatable products: disassembling the air pump body from the lower shell of the inflatable product; and connecting the first air outlet of the air pump body to air inlets of the other inflatable products through an air nozzle to inflate the other inflatable products.

19. The utilizing method according to claim 18, wherein in the inflatable product, the inflatable product body is further provided with a manual inflation and deflation valve.

* * * * *